US008539798B2

(12) United States Patent
Harrington

(10) Patent No.: US 8,539,798 B2
(45) Date of Patent: Sep. 24, 2013

(54) HANDCUFF APPARATUS

(75) Inventor: Robert Harrington, Asheville, NC (US)

(73) Assignee: Robert Harrington, Asheville, NC (US)

( * ) Notice: Subject to any disclaimer, the term of this patent is extended or adjusted under 35 U.S.C. 154(b) by 0 days.

(21) Appl. No.: 13/385,422

(22) Filed: Feb. 21, 2012

(65) Prior Publication Data

US 2013/0055772 A1 Mar. 7, 2013

Related U.S. Application Data

(63) Continuation-in-part of application No. 13/199,541, filed on Sep. 2, 2011.

(51) Int. Cl.
*E05B 75/00* (2006.01)

(52) U.S. Cl.
USPC ..... 70/16; 24/17 AP

(58) Field of Classification Search
USPC ..... 70/14–17; 24/24 PB, 17 AP
See application file for complete search history.

(56) References Cited

U.S. PATENT DOCUMENTS

| | | | | |
|---|---|---|---|---|
| 4,071,023 | A * | 1/1978 | Gregory | 70/16 |
| 4,910,831 | A * | 3/1990 | Bingold | 70/16 |
| 5,088,158 | A * | 2/1992 | Burkholder | 70/16 |
| 5,398,383 | A * | 3/1995 | Bingold | 70/16 |
| 5,443,155 | A * | 8/1995 | Robinson | 70/16 |
| 5,802,888 | A * | 9/1998 | Parsons | 70/16 |
| 6,101,682 | A * | 8/2000 | Parsons | 70/16 |
| 6,196,033 | B1 * | 3/2001 | Dowdle | 70/16 |
| 6,219,887 | B1 * | 4/2001 | Parsons | 70/16 |
| 6,446,474 | B1 * | 9/2002 | Tabacchi et al. | 70/16 |
| 6,532,631 | B2 * | 3/2003 | Rohaly et al. | 70/16 |
| 6,539,589 | B2 * | 4/2003 | Thompson | 70/16 |
| 7,882,599 | B2 * | 2/2011 | Harrington | 70/16 |

* cited by examiner

*Primary Examiner* — Christopher Boswell

(57) ABSTRACT

Handcuffs characterized by a single locking head/single strap support receiving a single handcuff strap. The single locking head/single strap support includes a manually movable locking member which includes locking member ratchets for engagement with the strap ratchets. With one embodiment of the single-strap handcuff apparatus of the invention, a two-link chain of single-strap handcuff apparatuses is formed. With another embodiment of the single-strap handcuff apparatus of the invention, a three-link chain of single-strap handcuff apparatuses is formed.

16 Claims, 10 Drawing Sheets

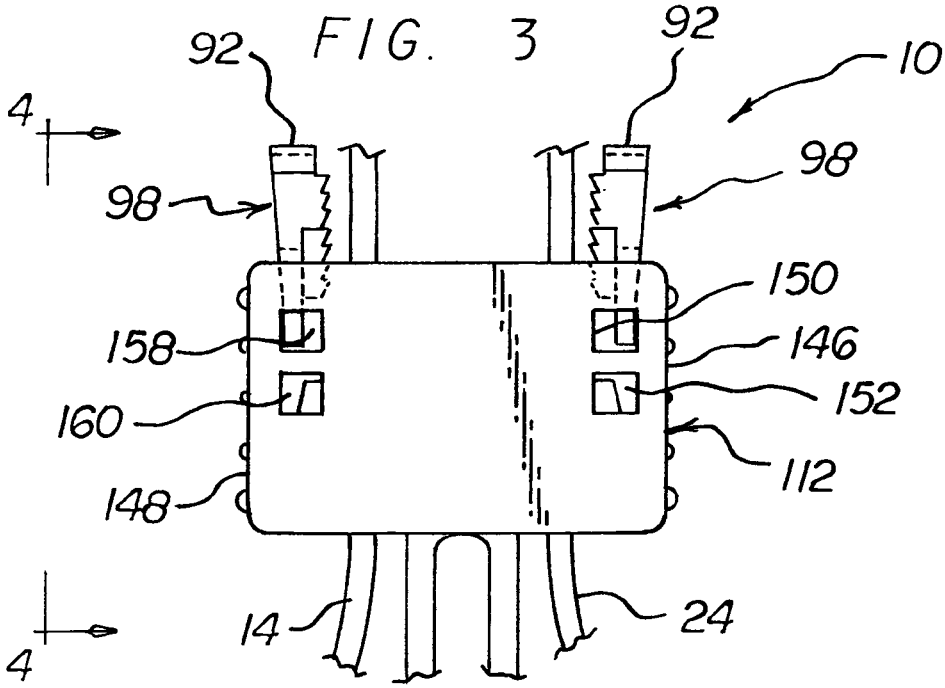
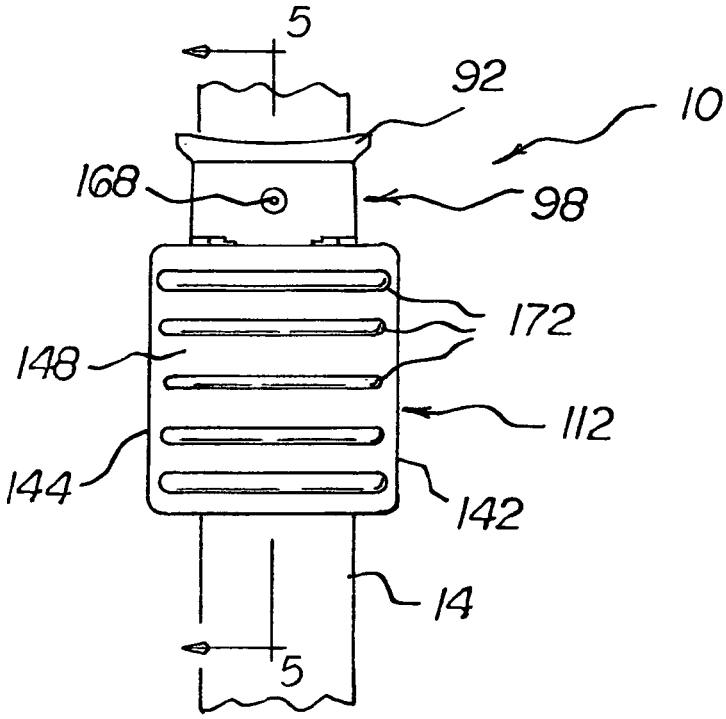
FIG. 4

FIG. 5
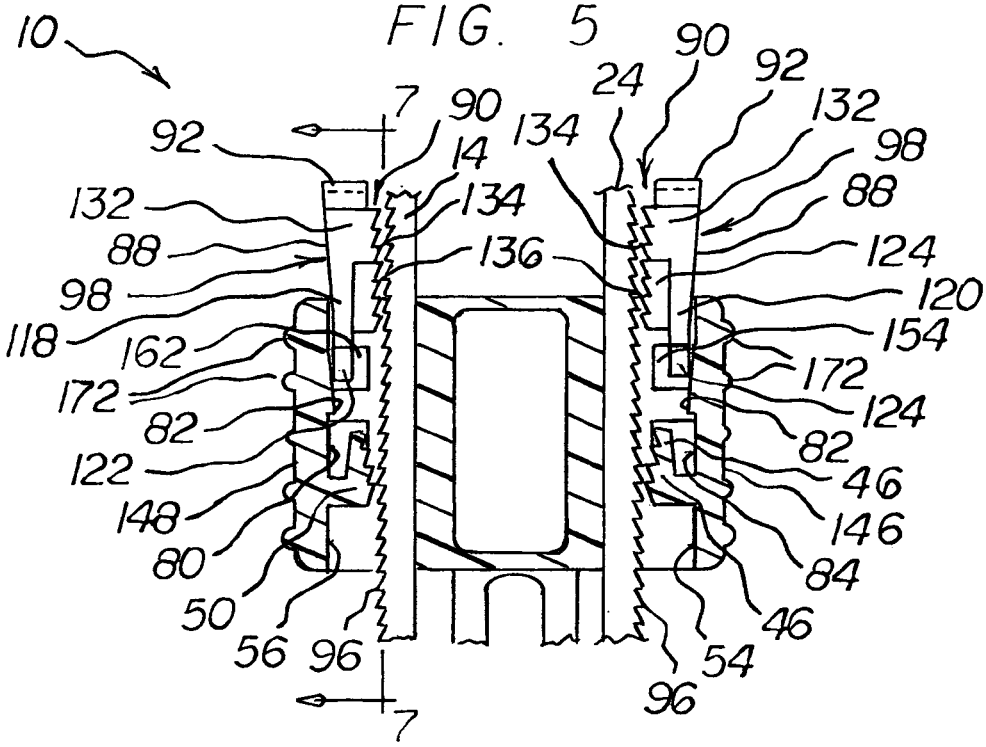
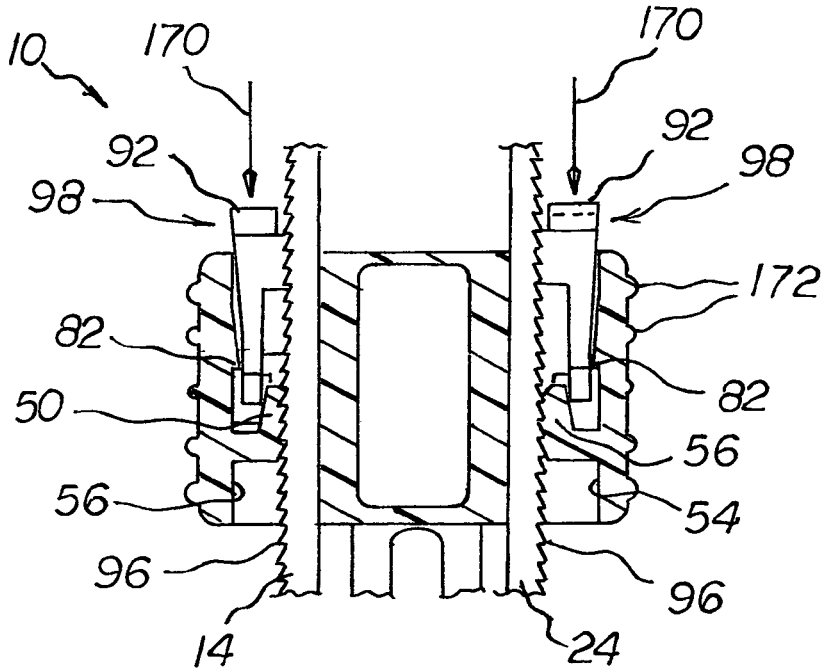
FIG. 6

FIG. 10
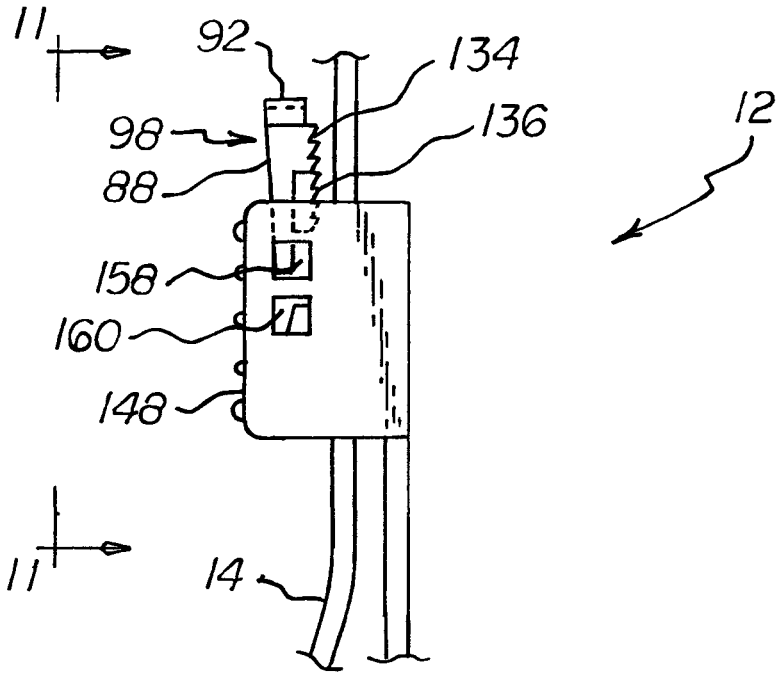
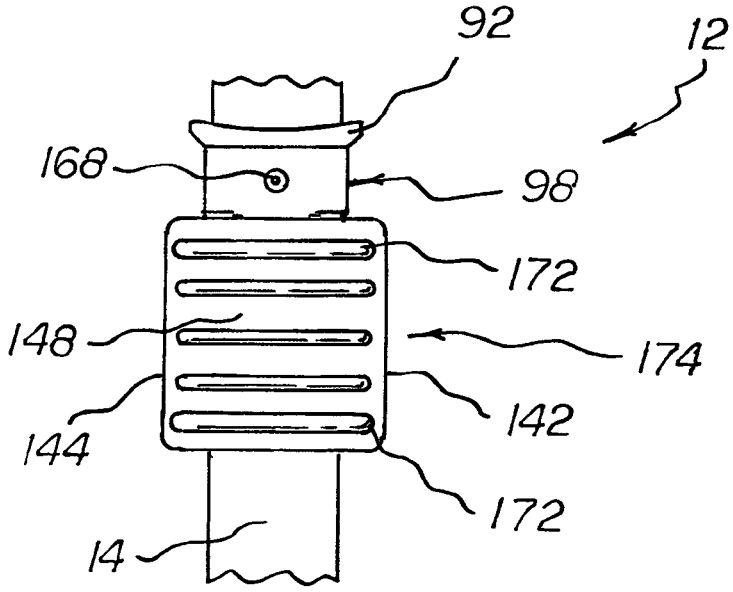
FIG. 11

FIG. 12
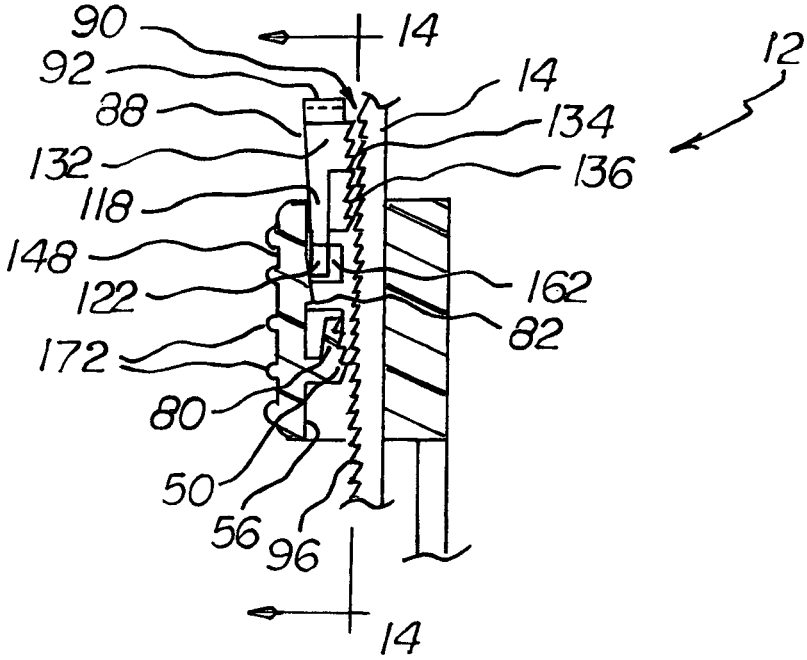
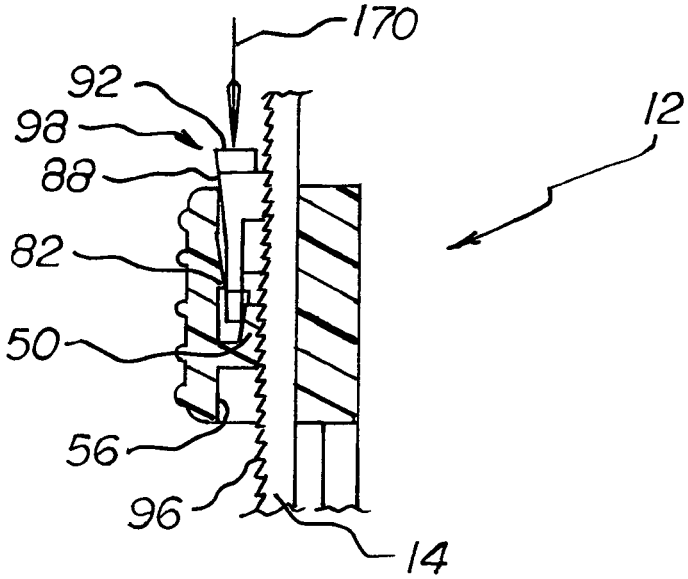
FIG. 13

FIG. 14
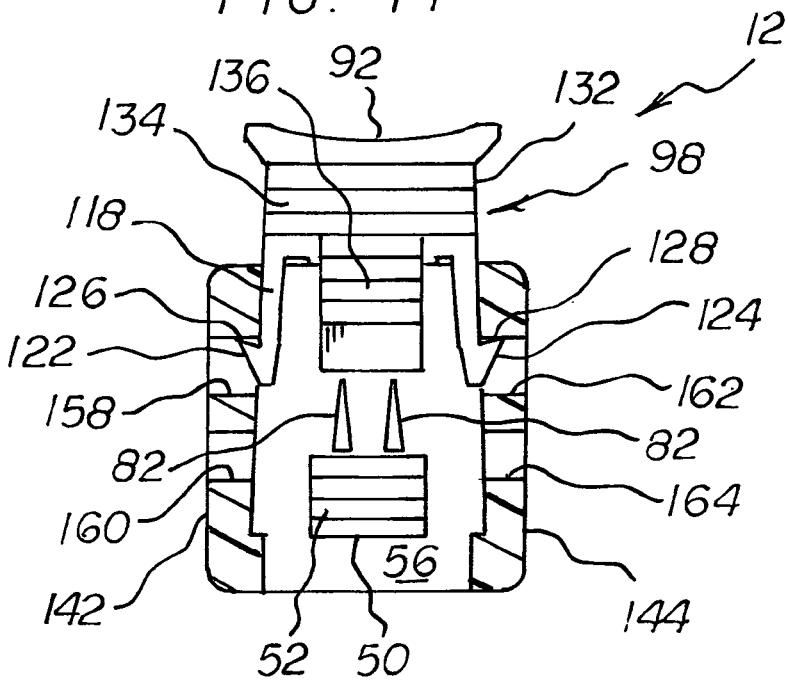
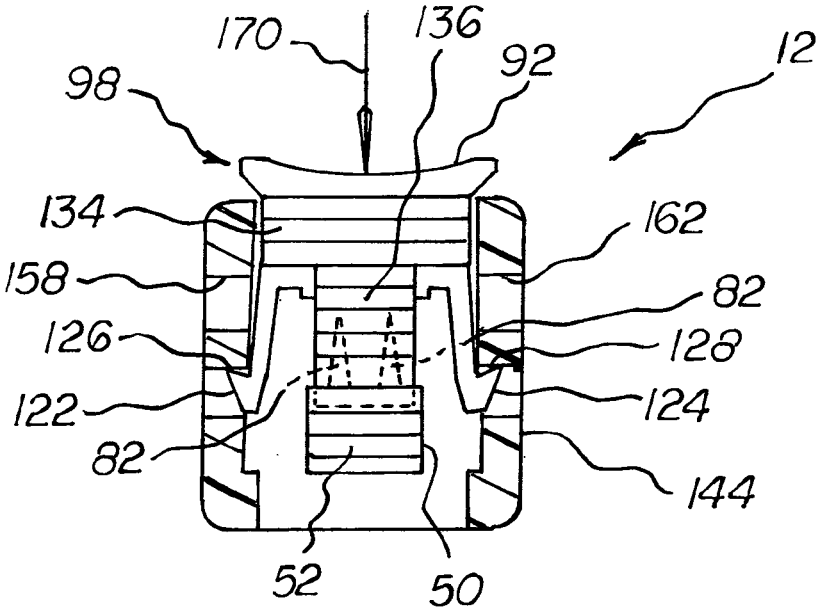
FIG. 15

HANDCUFF APPARATUS

CROSS-REFERENCE TO RELATED APPLICATION

This application is a continuation-in-part of and claims priority based upon my prior co-pending patent application Ser. No. 13/199,541, filed Sep. 2, 2011.

BACKGROUND OF THE INVENTION

1. Field of the Invention

The present invention relates generally to handcuff apparatuses, and, more particularly, to handcuff apparatuses that are especially adapted to be for single use and are disposable.

2. Description of the Related Art

The present invention is an improved handcuff apparatus that contains improvements to the handcuff apparatus disclosed by the same inventor in U.S. Pat. No. 7,882,599, incorporated herein by reference.

In U.S. Pat. No. 7,882,599, a top depressor portion 116 is disclosed which is convex in shape. Since a user's fingertips are also convex in shape, a user's fingertips can have a tendency to slide off of the convex top depressor portion 116. In this respect, it would be desirable if a top depressor portion were not convex in shape.

In U.S. Pat. No. 7,882,599, a manually movable locking member 114 is provided that has a top end camming ramp 140 which provides a locking camming action at the top of the manually movable locking member 114 against an inside flat channel wall of a locking head and strap support 112. As a result, with U.S. Pat. No. 7,882,599, although there is a locking camming action for the top end of the manually movable locking member 114, there is no locking camming action for the bottom end of the manually movable locking member 114. In this respect, to improve a secure locking of a manually movable locking member inside a locking head and strap support when the manually movable locking member 114 is in a locked position, it would be desirable for there to be a locking camming action for the bottom end of a manually movable locking member.

Thus, while the foregoing related art indicates it to be well known to use handcuff apparatuses, the related art described above does not teach or suggest an improved handcuff apparatus which has the following combination of desirable features: (1) has manually movable locking members each of which includes a top depressor portion which is not convex in shape; and (2) provides a locking camming action for the bottom ends of manually movable locking members.

The foregoing desired characteristics are provided by the unique improved handcuff apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a handcuff apparatus which includes a pair of handcuff straps which include strap ratchets. A locking head and strap support receives the handcuff straps. The locking head and strap support includes a pair of first inside channel walls and a pair of second inside channel walls. A pair of manually movable locking members are received in the locking head and strap support. Each of the manually movable locking members includes locking member ratchets for engagement with the strap ratchets, wherein each of the manually movable locking members includes a respective top end and a bottom end.

Channel wall compression ribs are located on the second inside channel walls. Each of the manually movable locking members includes a first side and a second side. The first side of each of the manually movable locking members includes locking member ratchets adapted to engage the strap ratchets when the manually movable locking members are in a locking condition with respect to the handcuff straps. Second sides of the manually movable locking members are smooth and engage the channel wall compression ribs when the manually movable locking members are in the locking condition. The channel wall compression ribs urge the ratchets on the strap members into secure engagement with complementary ratchets on the manually movable locking members.

Preferably, when the manually movable locking members are in a locking condition, the channel wall compression ribs are in registration with bottom ends of the manually movable locking members.

In addition, each of the manually movable locking members includes a concave top depressor portion.

In accordance with another embodiment of the invention, a single-strap handcuff apparatus is provided which includes a single handcuff strap which includes strap ratchets. A single locking head/single strap support receives the single handcuff strap. The single locking head/single strap support includes an inside channel wall. A manually movable locking member is received in the single locking head/single strap support. The manually movable locking member includes locking member ratchets for engagement with the strap ratchets. The manually movable locking member includes a respective top end and a bottom end. Channel wall compression ribs are located on the inside channel wall. The manually movable locking member includes a first side and a second side. The first side of the manually movable locking member includes the locking member ratchets adapted to engage the strap ratchets when the manually movable locking member is in a locking condition with respect to the single handcuff strap. The second side of the manually movable locking member is smooth and engages the channel wall compression ribs when the manually movable locking member is in the locking condition.

When the manually movable locking member is in a locking condition, the channel wall compression ribs are in registration with a bottom end of the manually movable locking member. The manually movable locking member includes a concave top depressor portion.

With one embodiment of the single-strap handcuff apparatus of the invention, a two-link chain of single-strap handcuff apparatuses includes a first single-strap handcuff apparatus which includes a first single locking head/single strap support and a first strap received in the first single locking head/single strap support, wherein, in an untightened condition, the first strap includes a first strap loop.

A second single-strap handcuff apparatus includes a second single locking head/single strap support and a second strap received in the second single locking head/single strap support, wherein, in an untightened condition, the second strap includes a second strap loop. The second strap loop is interengaged with the first strap loop, whereby the interengaged second strap loop and the first strap loop form a two-link chain of single-strap handcuff apparatuses.

With another embodiment of the single-strap handcuff apparatus of the invention, a three-link chain of single-strap handcuff apparatuses includes a first single-strap handcuff apparatus which includes a first single locking head/single strap support and a first strap received in the first single locking head/single strap support, wherein, in an untightened condition, the first strap includes a first strap loop.

A second single-strap handcuff apparatus includes a second single locking head/single strap support and a second strap that is received in the second single locking head/single strap support, wherein, in an untightened condition, the second strap includes a second strap loop.

A third single-strap handcuff apparatus includes a third single locking head/single strap support and a third strap received in the third single locking head/single strap support, wherein, in an untightened condition, the third strap includes a third strap loop. The first strap loop is in looped engagement with the second strap loop. The second strap loop is in looped engagement with the third strap loop, such that the second strap loop is located between the first strap loop and the third strap loop, whereby the first strap loop, the second strap loop, and the third strap loop form a three-link chain of single-strap handcuff apparatuses.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved handcuff apparatus which has all of the advantages of the prior art and none of the disadvantages.

It is another object of the present invention to provide a new and improved handcuff apparatus which may be easily and efficiently manufactured and marketed.

It is a further object of the present invention to provide a new and improved handcuff apparatus which is of durable and reliable construction.

An even further object of the present invention is to provide a new and improved handcuff apparatus which is susceptible of a low cost of manufacture with regard to both materials and labor, and which accordingly is then susceptible of low prices of sale to the consuming public, thereby making such improved handcuff apparatus available to the buying public.

Still yet a further object of the present invention is to provide a new and improved handcuff apparatus which has manually movable locking members each of which includes a top depressor portion which is not convex in shape.

Still another object of the present invention is to provide a new and improved handcuff apparatus that provides a locking camming action for the bottom ends of manually movable locking members.

Yet another object of the present invention is to provide both a double-strap handcuff apparatus and a single-strap handcuff apparatus.

Still another object of the present invention is to provide a two-link chain of single-strap handcuff apparatuses and a three-link chain of single-strap handcuff apparatuses.

Yet still another object of the present invention is to provide a single strap handcuff apparatus that is foldable in the untightened condition to provide for compact storage.

Still yet another object of the present invention is to provide a single-strap foldable handcuff apparatus that has a movable locking member which when locked in the tightened condition prevents the strap from being further tightened.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a front view in elevation of a combined locking head and strap support portion of an embodiment of a double-strap handcuff apparatus of the present invention.

FIG. 4 is a side view in elevation of the combined locking head and strap support portion of the embodiment of the double-strap handcuff apparatus of the invention depicted in FIG. 3.

FIG. 5 is a cross-sectional view taken along line 5-5 in FIG. 4 showing a manually movable locking member in a non-locked position within the locking head of the double-strap handcuff apparatus embodiment of the invention.

FIG. 6 is a cross-sectional view taken along line 5-5 in FIG. 4 showing manually movable locking member in a locked position within the locking head.

FIG. 10 is a front view in elevation of a single locking head/single strap support portion of an embodiment of a single-strap handcuff apparatus of the present invention.

FIG. 11 is a side view in elevation of the single locking head/single strap support portion of the embodiment of the single-strap handcuff apparatus of the invention taken along line 11-11 in FIG. 10.

FIG. 12 is a cross-sectional of the single locking head/single strap support shown in FIG. 10 showing a manually movable locking member in a non-locked position within the single locking head/single strap support of the single-strap handcuff apparatus embodiment of the invention.

FIG. 13 is a cross-sectional view of the single locking head/single strap support in FIG. 12 showing manually movable locking member in a locked position within the single locking head/single strap support.

FIG. 14 is a cross-sectional view taken along line 14-14 in FIG. 12 showing the manually movable locking member in a non-locked position within the single locking head/single strap support.

FIG. 15 is a cross-sectional view from FIG. 14 showing the manually movable locking member in a locked position within the single locking head/single strap support.

DESCRIPTION OF THE PREFERRED EMBODIMENT

With reference to the drawings, a new and improved handcuff apparatus embodying the principles and concepts of the present invention will be described.

Figure 1:
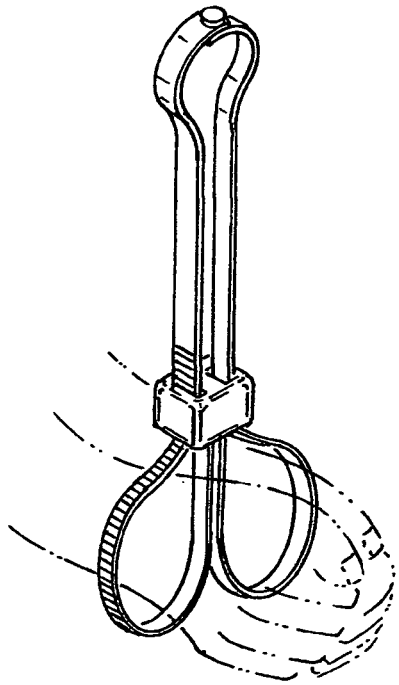
FIG. 1 RELATED ART
FIG. 1 is perspective view of a RELATED ART handcuff apparatus disclosed in FIG. 8 of U.S. Pat. No. 7,882,599, incorporated herein by reference.
Figure 2:
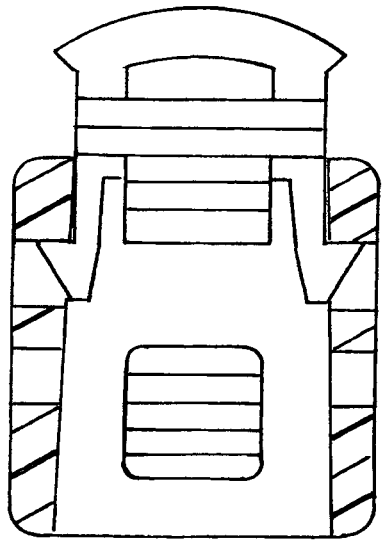
FIG. 2 RELATED ART
FIG. 2 is an enlarged view of a RELATED ART manually movable locking member disclosed in FIG. 13 of U.S. Pat. No. 7,882,599, incorporated herein by reference.
Figure 8:
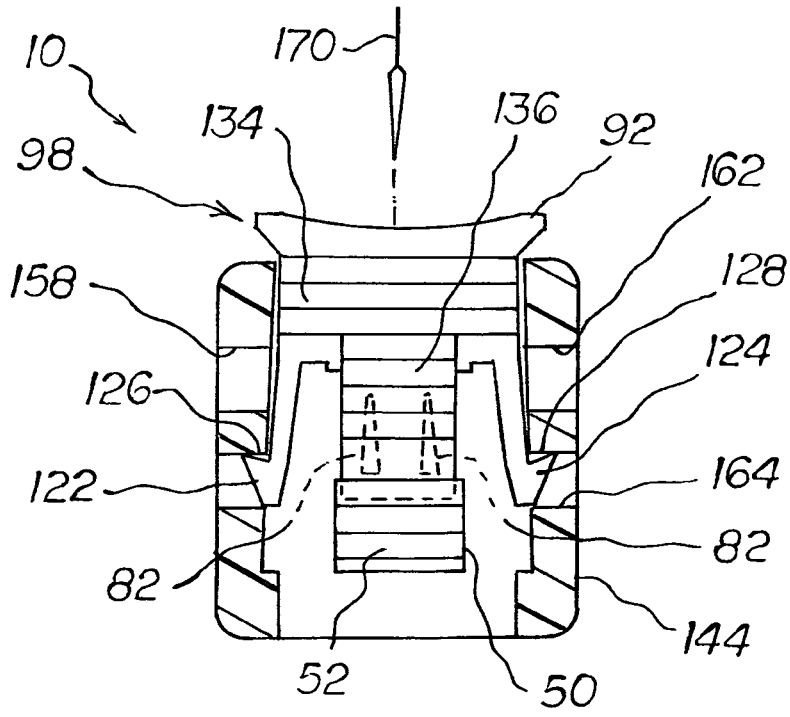
FIG. 8 is a cross-sectional view taken along line 7-7 in FIG. 5 showing the manually movable locking member in a locked position within the locking head.

As stated above, FIG. 1 is perspective view of a RELATED ART handcuff apparatus, by the present inventor, disclosed in FIG. 8 of U.S. Pat. No. 7,882,599, incorporated herein by reference. In addition, FIG. 2 is an enlarged view of a RELATED ART manually movable locking member, by the present inventor, disclosed in FIG. 13 of U.S. Pat. No. 7,882,599, incorporated herein by reference.

In FIG. 1, a handcuff apparatus disclosed in FIG. 8 of U.S. Pat. No. 7,882,599 is presented.

Turning to FIGS. 3-8, there is shown a preferred embodiment of the double-strap handcuff apparatus of the invention generally designated by reference numeral 10. In each of the figures, reference numerals are shown that correspond to like reference numerals that designate like elements shown in other figures.

In the preferred embodiment, improved handcuff apparatus 10 includes a way to render the handcuff apparatus of the present invention substantially pick-proof. In this respect, the subject invention includes a sliding manually movable locking member 98 in conjunction with the locking head and strap support. Such a preferred embodiment is shown in FIGS. 3-8 where the locking head and strap support 112 is somewhat enlarged transversely to accommodate a manually movable locking member 98.

In accordance with the present invention, the manually movable locking member 98 generally is U-shaped and includes a concave top depressor portion 92 and a pair of opposed retainer prongs 118, 120 each of which terminates distally in a corresponding outwardly extending barb 122, 124, substantially as depicted. The concave top depressor portion 92 is readily adapted to receive a user's finger which is complementarily convex in shape.

Figure 7:
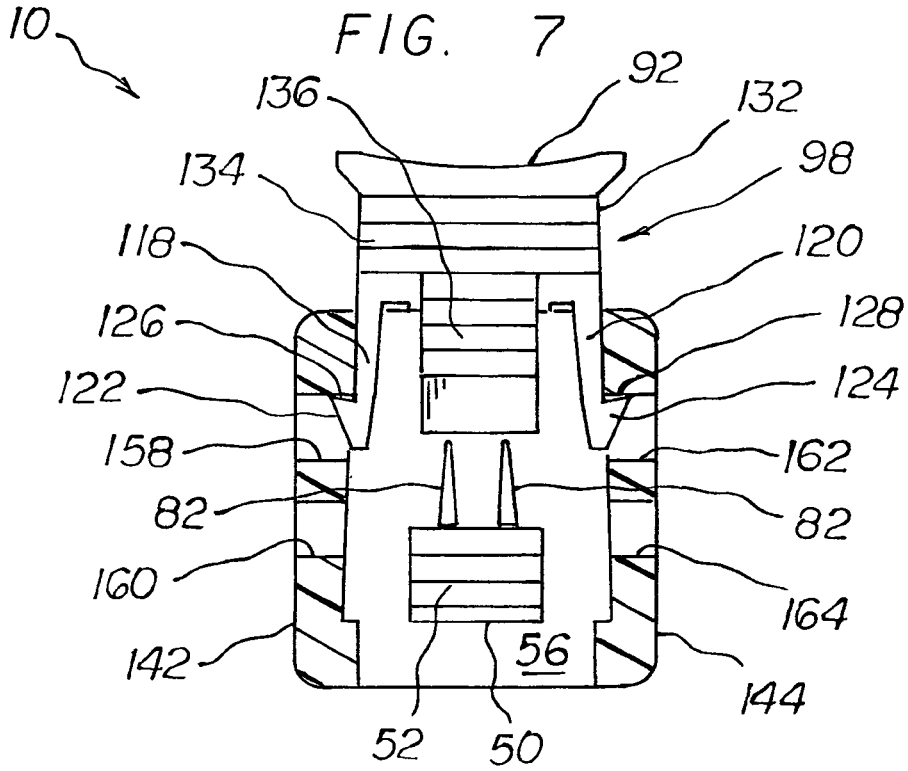
FIG. 7 is a cross-sectional view taken along line 7-7 in FIG. 5 showing the manually movable locking member in a non-locked position within the locking head.

Each barb 122, 124, in turn, defines an upwardly facing bearing shoulder surface or ledge 126, 128. A first or front side 130 of manually movable locking member 98 has a T-shaped locking ratchet support member 132 thereon having a first portion defining a first series of unidirectional locking member ratchets 134 which extend transversely above prongs 118, 120 substantially entirely the full width of the manually movable locking member 98 essentially as depicted in FIGS. 7 and 8. T-shaped locking ratchet support member 132 has a further portion extending downwardly to define a second series of unidirectional locking member ratchet teeth 136 which extend transversely between prongs 118, 120. Thus, the first series of locking member ratchets 134 has a transverse extent greater than the transverse extent of the second series of locking member ratchets 136. On the second side 88 or opposed side of manually movable locking member 98, proximal to concave top depressor portion 92, is a camming ramp substantially as shown in FIG. 5, the purpose of which will be described more fully below.

In addition, the first strap reception channel 54 includes a first inside channel wall 80 from which at least one channel wall compression rib 82 projects. Also, the second strap reception channel 56 includes a second inside channel wall 84 from which at least one channel wall compression rib 82 projects.

Also, the manually movable locking member 98 includes a first side and a second side, wherein the first side 90 of the manually movable locking member 98 includes third unidirectional locking member ratchets adapted to engage strap ratchets on either said first or second handcuff straps, wherein the strap ratchets are unidirectional ratchet members which engage the manually movable locking member 98 only when the manually movable locking member 98 is in the locking condition.

Also, in accordance with the present invention, the second side 88 of the manually movable locking member 98 is smooth and engages the channel wall compression ribs 82 when the manually movable locking member 98 is in the locking condition. Preferably, when the manually movable locking member 98 is in the "locked" or "locking" condition, the channel wall compression ribs 82 are in registration with the bottom ends of the manually movable locking member 98. In this way, the channel wall compression ribs 82 urge the ratchets at the bottom end of the manually movable locking member 98 into secure locked engagement with the complementary ratchets (strap ratchets 96) on the straps 14 and 24. In this respect, when the channel wall compression ribs 82 are compressed against the manually movable locking member 98, the ratchet members (locking member ratchets 136) of the manually movable locking member 98 are even more securely wedged into the corresponding ratchet members 96 of the straps 14 and 24, in addition to the camming action of the camming ramp on the second side 88 of the manually movable locking member 98.

Preferably, the channel wall compression ribs 82 are molded into the of the first inside channel wall 80 and the second inside channel wall 84.

For a handcuff apparatus which is reusable, the channel wall compression ribs 82 can be made from resilient material. For a single-use handcuff apparatus, the channel wall compression ribs 82 can be made from crushable material.

Locking head and strap support 112 includes a pair of parallel substantially parallel strap reception channels 54, 56, and first and second locking ratchet support members 46 and 50, each carrying respective unidirectional locking ratchets 48 and 52. Locking head and strap support 112 has a front wall 142, a back wall 144, a first side wall 146, and a second side wall 148. Front and back walls 142, 144 furthermore include pairs of longitudinally spaced axially aligned through openings proximal to the inside surface of each opposed first and second side wall 146, 148, respectively. Thus, with reference to FIGS. 3 and 5-8, a first pair of through openings 150, 152 is provided in front wall 142 in axial alignment with a second pair of through openings 154,156 provided in back wall 144. Similarly, a third pair of through openings 158, 160, is provided in front wall 142 in axial alignment with a fourth pair of through openings 162, 164 provided in back wall 144.

In accordance with the present invention, axially aligned through holes or openings 150, 154 are adapted to locate and capture manually movable locking member 98 in a first "non-locking" location in strap reception channel 54; axially aligned through openings 152, 156 are adapted to locate and capture manually movable locking member 98 in a second or "locking" condition in strap reception channel 54; axially aligned through openings 158, 162 are adapted to locate and capture manually movable locking member 98 in a first "non-locking" location in strap reception channel 56; and axially aligned through openings 160, 164 are adapted to locate and capture manually movable locking member 98 in a second or "locking" condition in strap reception channel 56.

More specifically, each manually movable locking member 98 is adapted to be supported in either a "locking" or "non-locking" condition inside its respective strap reception channel 54 and 56 by the engagement of the distal outwardly extending barbs 122, 124, on clip prongs 118, 120 of the manually movable locking member 98, respectively, in a corresponding pair of opposed, axially aligned openings in front wall 142 and back wall 144, respectively. Such engagement is characterized by abutting contact between the upwardly facing bearing shoulder surface or ledge 126, 128 of each barb and the corresponding upper wall surface or ceiling defined by each through opening respectively (FIGS. 7 and 8).

Deployment of the embodiment of FIGS. 3-8 employs the step of pressing down on the concave top depressor portions 92 of the manually movable locking members 98 after the ends of the first handcuff strap 14 and the second handcuff strap 24 are pulled away from the combination locking head and strap support 112 such that the first handcuff strap 14 and the second handcuff strap 24 are tight around the respective wrists encircled therein (e.g. see FIG. 8 of U.S. Pat. No. 7,882,599, incorporated herein by reference). When this is done, each manually movable locking member 98 appears and is in the "non-locking" position substantially as depicted herein in FIGS. 3-5 and 7. Next each manually movable locking member 98 is slidingly moved from the "non-locking" condition to the "locking" condition by depressing concave top depressor portion 92 on the upper or top portion of the clip sufficiently to move the entire clip downwardly into its respective strap reception channel as schematically by arrows 170 in FIG. 6 (see also FIGS. 7-8). Such movement continues until the barbs on the prongs of the manually movable locking member 98 enter and engage openings 152, 156 and 160, 164 on the front and back walls 142, and 144, respectively, in a "snap-fit" manner thereby re-engaging those walls by being captured in their subsequent through openings.

It will be appreciated that because the barbs have angled surfaces, and the prongs are somewhat flexible, relatively light downward pressure on the concave top depressor portion 92 facilitates release of engagement from the top row of through openings (non-locking) 150, 154, 158, 162 and "snap-fit" re-engagement in the bottom row of through openings (locking) 152, 156, 160, 164, as viewed in the drawings. It will also be appreciated that as a result of the camming action of the second side 88 of the manually movable locking member 98, the T-shaped locking ratchet support member 132 and the ratchets thereon are urged toward and into locking engagement with corresponding unidirectional ratchet teeth on each strap received in each strap reception channel as best viewed in FIG. 6. In this "locking" position, it is noted that the bottom portion of the T-shaped locking ratchet support member 132 (second series of unidirectional locking ratchets 136 extending transversely between prongs 118, 120) on each clip comes into abutting contact against the top portion of locking ratchet support members 46 and 50 respectively (FIGS. 6, 8) and remains locked in place in that position when the barbs on the prongs of each clip are "snap fit" engaged in their subsequent bottom row of wall openings, respectively. By this action, not only are the unidirectional locking ratchets on each ratchet support member 46 and 50 engaging corresponding unidirectional locking ratchets on each strap 14,24, but additionally, the first series of unidirectional locking ratchets 134 which extend transversely above prongs 118, 120 substantially entirely the full width of the manually movable locking member 98, and the second series of unidirectional locking ratchets 136 on the T-shaped ratchet teeth support member 132, also are engaging corresponding additional teeth on each strap, respectively. This unique preferred arrangement thus renders the handcuff apparatus of the present invention substantially pick-proof because in the "locking condition" afforded by the depressible, manually movable locking member 98, the total number of unidirectional locking ratchets on the preferred locking head and strap support (with manually movable locking member 98) engaging each strap is increased dramatically.

In using the embodiment of FIGS. 3-8, it is preferred that manually movable locking member 98 be fabricated from a material that is somewhat harder and tougher than the thermoplastic material used to mold the straps and the combined locking head and strap support. A suitable material meeting this desideratum is a polyamide (Nylon), and such material is particularly preferred. Finally, it may be desirable to provide a signalling device on the outwardly facing surface of each clip to indicate it is in the non-locking condition. Such a signalling device may be a colored dot 168 on the surface of the manually movable locking member 98 proximal to concave top depressor portion 92 (FIG. 4) and which is clearly visible when the manually movable locking member 98 is in the raised or "non-locking" condition, but which is not visible when the manually movable locking member 98 is depressed and in the locking condition (FIGS. 6 and 8). In addition, if desired, a series of molded rounded projections or ridges 172 may be formed (molded) on side walls 146 and 148 to enhance the grip-ability of the combined locking head and strap support substantially as depicted in FIGS. 3-6.

Now turning to FIGS. 9-18, details of ALTERNATIVELY preferred embodiments of the single-strap handcuff apparatus 12 of the invention are shown and described.

A single-strap handcuff apparatus 12 is provided which includes a single handcuff strap 14 which includes strap ratchets 96. A single locking head/single strap support 174 receives the single handcuff strap 14. The single locking head/single strap support 174 includes an inside channel wall 80. A manually movable locking member 98 is received in the single locking head/single strap support 174. The manually movable locking member 98 includes locking member ratchets 134 for engagement with the strap ratchets 96. The manually movable locking member 98 includes a respective top end and a bottom end. Channel wall compression ribs 82 are located on the inside channel wall 80. The manually movable locking member 98 includes a first side 90 and a second side 88. The first side 90 of the manually movable locking member 98 includes the locking member ratchets 134 adapted to engage the strap ratchets 96 when the manually movable locking member 98 is in a locking condition with respect to the single handcuff strap 14. The second side 88 of the manually movable locking member 98 is smooth and engages the channel wall compression ribs 82 when the manually movable locking member 98 is in the locking condition.

When the manually movable locking member 98 is in a locking condition, the channel wall compression ribs 82 are in registration with a bottom end of the manually movable locking member 98. The manually movable locking member 98 includes a concave top depressor portion 92.

Figure 9:
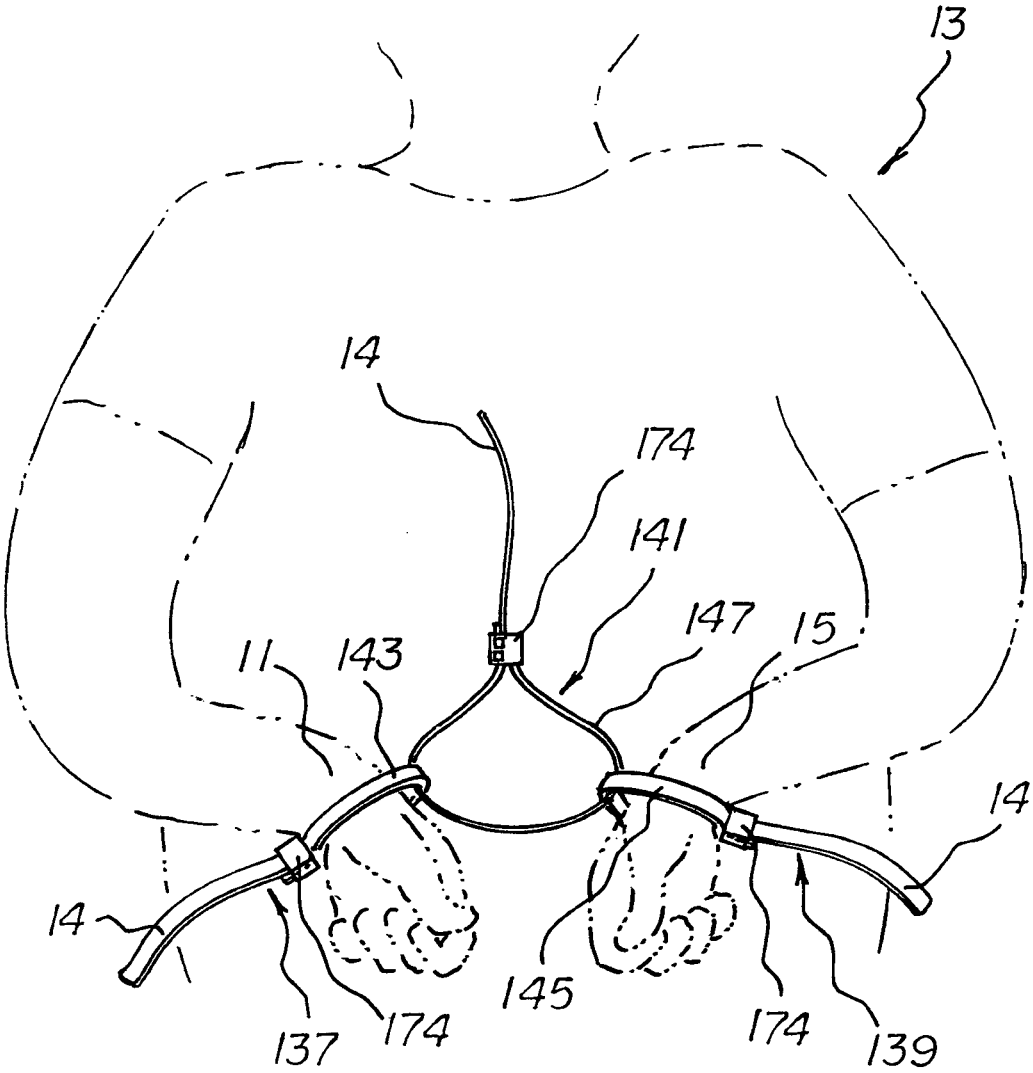
FIG. 9 is a rear view of a three-link chain embodiment of the invention using three single-strap handcuff apparatuses of the invention.

Although not shown in the drawings, but related to FIG. 9, a two-link chain of single-strap handcuff apparatuses 12 includes a first single-strap handcuff apparatus 12 which includes a first single locking head/single strap support 174 and a first strap 14 received in the first single locking head/single strap support 174, wherein, in an untightened condition, the first strap 14 includes a first strap loop 143.

A second single-strap handcuff apparatus 12 includes a second single locking head/single strap support 174 and a second strap 14 received in the second single locking head/single strap support 174, wherein, in an untightened condition, the second strap 14 includes a second strap loop 147. The second strap loop 147 is interengaged with the first strap loop 143, whereby the interengaged second strap loop 147 and the first strap loop 143 form a two-link chain of single-strap handcuff apparatuses.

To use the two-link chain of single-strap handcuff apparatuses, the first single-strap handcuff apparatus 12 is taken by a user. The first strap loop 143 is earlier formed. Then, the second strap 14 of the second single-strap handcuff apparatus 12 is threaded through the first strap loop 143. Then, the second strap 14 of the second single-strap handcuff apparatus 12 is inserted into the second single locking head/single strap support 174, whereby the second strap loop 147 is formed and is in untightened looped engagement with the first strap loop 143.

To use the two-link chain of single-strap handcuff apparatuses. An untightened first strap loop 143 is placed on the first wrist 11 of a person, and the first strap 14 is pulled to tighten and lock the first strap loop to have a tight fit on the first wrist 11. Then, an untightened second strap loop 147 is placed on the second wrist 15 of the person 13, and the second strap 14 is pulled to tighten and lock the second strap loop 147 to have a tight fit on the second wrist 15. When the above-described steps are taken, the first strap loop 143 is tight and locked on the first wrist 11, the second strap loop 147 is tight and locked on the second wrist 15, and the interlooped first strap loop 143 and second strap loop 147 are tightly engaging each other in locked engagement.

As shown in FIG. 9, a three-link chain of single-strap handcuff apparatuses includes a first single-strap handcuff apparatus 12 which includes a first single locking head/single strap support 174 and a first strap 14 received in the first single locking head/single strap support 174, wherein, in an untightened condition, the first strap 14 includes a first strap loop 143.

A second single-strap handcuff apparatus 12 includes a second single locking head/single strap support 174 and a second strap 14 that is received in the second single locking head/single strap support 174, wherein, in an untightened condition, the second strap 14 includes a second strap loop 147.

A third single-strap handcuff apparatus 12 includes a third single locking head/single strap support 174 and a third strap 14 received in the third single locking head/single strap support 174, wherein, in an untightened condition, the third strap 14 includes a third strap loop 145. The first strap loop 143 is in looped engagement with the second strap loop 147. The second strap loop 147 is in looped engagement with the third strap loop 145, such that the second strap loop 147 is located between the first strap loop 143 and the third strap loop 145, whereby the first strap loop 143, the second strap loop 147, and the third strap loop 145 form a three-link chain of single-strap handcuff apparatuses.

For a user to use the three-link chain of single-strap handcuff apparatuses. An untightened first strap loop 143 is placed around the first wrist 11 of the person 13, and the first strap 14 is pulled by the user to tighten and lock the first strap loop 143 onto the first wrist 11. Then, an untightened third strap loop 145 is placed around the second wrist 15 of the person, and the third strap 14 is pulled by the user to tighten and lock the third strap loop 145 onto the second wrist 15. Then, the user pulls on the second strap 14 to tighten and lock the second strap loop 147 between the first strap loop 143 and the third strap loop 145.

More specifically, with a person 13 has a narrow girth, when the second strap loop 147 is tightened and locked between the tightened and locked first strap loop 143 and the tightened and locked third strap loop 145, the first wrist 11 and the second wrist 15 can be touching each other, and the tightened and locked first strap loop 143 and the tightened and locked third strap loop 145 can be touching each other also.

In contrast, with a person 13 of wide girth, when the second strap loop 147 is tightened and locked between the tightened and locked first strap loop 143 and the tightened and locked third strap loop 145, the first wrist 11 and the second wrist 15 may be spaced apart from each other, as shown in FIG. 9, and the first strap loop 143 and the third strap loop 145 may also be spaced apart from each other as shown in FIG. 9 also.

It is also noted that a single-strap handcuff apparatus 12 such as shown in FIGS. 9-15 is more easy to mold and manufacture than a double-strap handcuff apparatus 10 shown in FIGS. 1-8. Of greater interest is that two single-strap handcuff apparatuses 12 are more easy to mold and manufacture than one double-strap handcuff apparatus 10.

Figure 16:
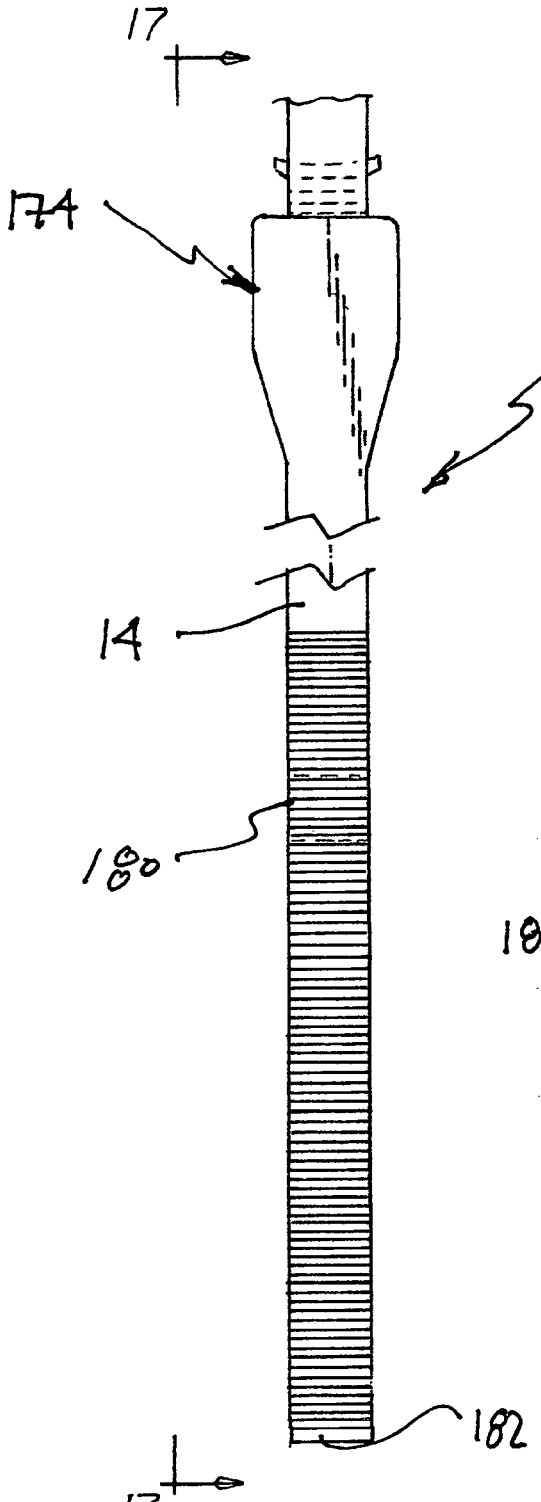
FIG. 16 is a rear view of an alternatively preferred embodiment of the single locking head/single strap handcuff apparatus of FIG. 10 wherein the strap portion is foldable to facilitate compact storage.
Figure 17:
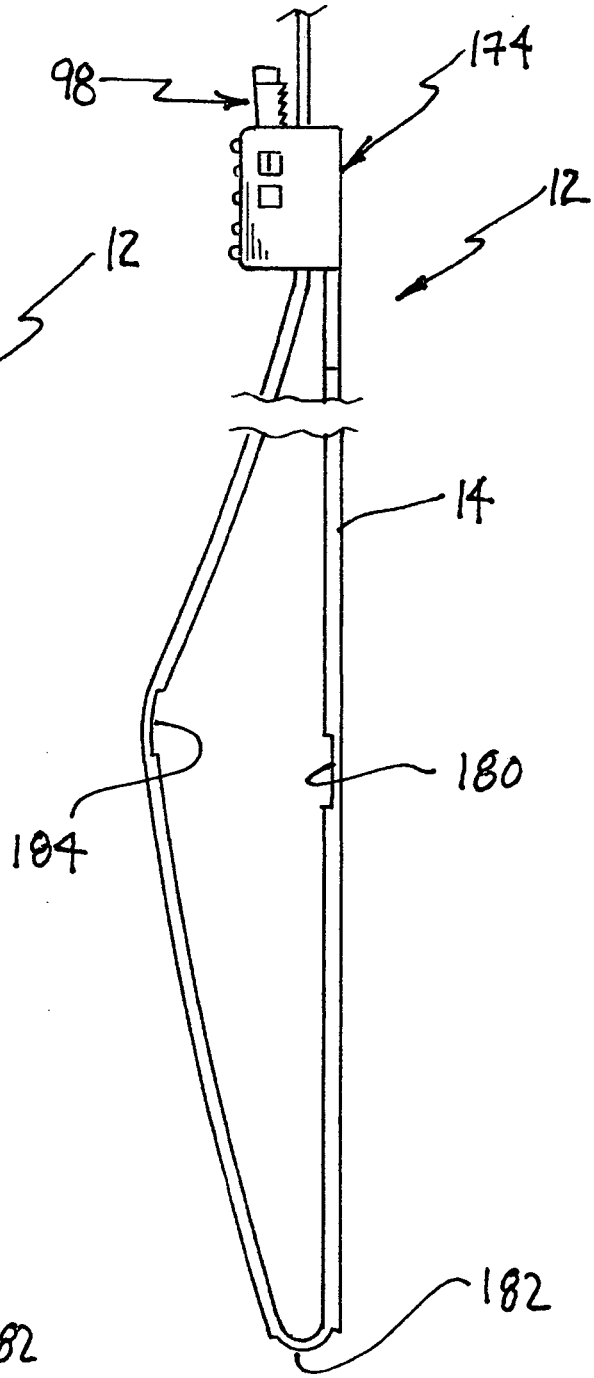
FIG. 17 is a side view of the alternatively preferred embodiment of FIG. 16 showing the strap portion in an unfolded condition.
Figure 18:
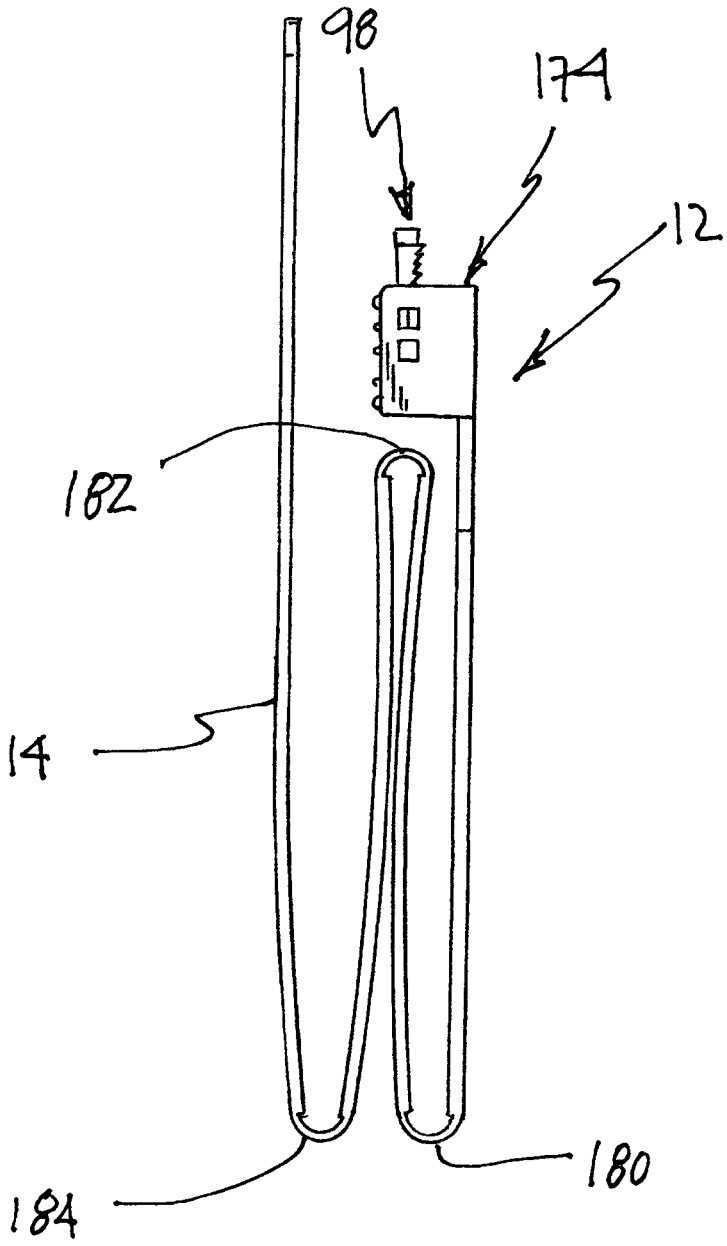
FIG. 18 is a side view of the alternatively preferred embodiment of FIG. 17 showing the strap portion in the folded condition or compact storage condition.

An important feature of the present invention is that the strap 14 of single single-strap handcuff apparatus 12 may be provided in a foldable condition. This unique arrangement is illustrated in FIGS. 16-18. As substantially depicted therein, strap 14 is provided with first, second, and third reduced wall-thickness sections 180, 182, and 184, respectively defining first, second and third crease or hinge sections, respectively. The strap 12 suitably may be folded about these crease sections to be deployed in the storage mode (FIG. 18), or may be unfolded so as to be deployed in the ready-to-use mode (FIG. 17). It will be appreciated that in the storage configuration of FIG. 18, the handcuff apparatus 12 is compact and takes up relatively little storage space easily enabling a multiplicity of handcuff apparatuses to be carried in a pocket or utility pouch.

The components of the improved handcuff apparatus of the invention can be made from inexpensive and durable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved handcuff apparatus that is low in cost, relatively simple in design and operation, and which may advantageously be used to provide manually movable locking members each of which includes a top depressor portion which is not convex in shape. Also, with the invention, an improved handcuff apparatus provides a locking camming action for the bottom end of a manually movable locking member. With the present invention a single strap/locking head handcuff apparatus is provided having a foldable strap for compact storage. With the present invention there is provided a movable locking member that when moved to the locking condition causes engagement not only with the strap ratchets, but also with the locking head itself thereby preventing an over-tightened condition. With the present invention a multiplicity of single strap handcuff apparatuses may be interlocked together to fit large girth people, or to be used as leg restraints, if desired.

The proper scope of the present invention should be determined only by the broadest interpretation of the appended claims so as to encompass all obvious modifications as well as all relationships equivalent to those illustrated in the drawings and described in the specification.

What is claimed as being new and desired to be protected by Letters Patent of the United States is as follows:

1. Restraining apparatus comprising:

an elongated strap, said elongated strap having a free first end and an opposed second end, a locking head for said strap, said locking head being integrally attached to said opposed second end of said strap to form a unitary combined locking head and strap, said strap having first and second opposed sides, said first opposed side of said strap having thereon unidirectional ratchet members, said second opposed side of said strap being substantially smooth, said locking head having a first end integrally attached proximally to said opposed second end of said strap, and a second opposed end extending axially and distally with respect to said opposed second end of said strap and said locking head first end, said locking head further having a strap reception channel extending axially through said locking head between said first end to said second end thereof, said strap reception channel having first and second opposed, spaced wall surfaces whereby said free first end of said strap is adapted to be inserted into said strap reception channel and be slidably axially passed therethrough with said second substantially smooth first opposed side of said strap bearing against said first opposed spaced wall surface and said first opposed side of said strap having thereon unidirectional ratchet members facing said second opposed, spaced wall surface of said strap reception channel and being spaced therefrom, said strap reception channel having third and fourth opposed, spaced wall surfaces substantially perpendicular to said first and second opposed, spaced wall surfaces, respectively, to define an axial clearance space for a movable locking member axially movable in said clearance space between a first non-locked condition and a second locked condition, a locking ratchet support member affixed to said second opposed, spaced wall surface and adapted to be urged by wedging action into said clearance space toward said first opposed, spaced wall surface, said support member having thereon a first series of ratchet locking members confronting said first opposed, spaced wall surface, and a movable locking member, said movable locking member having first and second opposed sides, said first opposed side of said movable locking member being substantially smooth, said second opposed side of said movable locking member having a second series of locking ratchets thereon, said movable locking member being affixed in said clearance space in juxtaposed confronting relation to said strap reception channel first opposed, spaced wall surface and adapted to be movable axially within said clearance space between a first non-locked condition and a second locked condition, and at least one cam member located on said strap reception channel second opposed, spaced wall surface between said movable locking member affixed therein and said locking ratchet support member, wherein movement of said movable locking member axially in said clearance space from said un-locked condition to said locked condition is adapted to cause said locking member to engage said cam member and be wedged against said locking ratchet support member sufficiently to urge said first series of locking ratchets into engagement with said unidirectional ratchet members on said first opposed side of said strap and simultaneously to cause said second series of locking ratchets on said second opposed side of said movable locking member to engage corresponding unidirectional ratchet members on said first opposed side of said strap other than the corresponding unidirectional ratchet members engaged by said first series of locking ratchets on said locking ratchet support member when said strap is received within said strap reception channel, said apparatus further including:

a third series of locking ratchets, said third series of locking ratchets being located on said movable locking member in a position extending axially beyond said second series on said movable locking member and said first series on said locking ratchet support member.

2. The apparatus of claim 1 wherein said combined unitary locking head and elongated strap are molded from a first material and said movable locking member is molded from a second material.

3. The apparatus of claim 2 wherein said second material is harder than said first material.

4. The apparatus of claim 3 wherein said second material is a polyamide.

5. The apparatus of claim 1 wherein said first elongated strap includes a first proximal folding crease and a first distal folding crease located on said first smooth side and includes a first intermediate folding crease located on said first ratchet-bearing side.

6. The apparatus of claim 1 wherein said locking head includes first capturing means for retaining said movable locking member in said non-locked condition.

7. The apparatus of claim 6 wherein said locking head includes second capturing means for retaining said movable locking member in said locked condition.

8. The apparatus of claim 7 wherein said movable locking member further includes first and second opposed flexible barb portions, said first capturing means includes a first pair of aligned openings in said locking head intercepting said third and fourth strap reception channel opposed, spaced wall surfaces, respectively, and wherein said second capturing means includes a second pair of aligned openings in said locking head intercepting said third and fourth strap reception channel opposed, spaced wall surfaces, respectively, whereby said first and second flexible barb portions engage said first pair of aligned openings, respectively, when said movable locking member is in the non-locked condition, and wherein said first and second flexible barb portions are adapted to engage said second pair of aligned openings, respectively, when said movable locking member is in the locked condition.

9. The apparatus of claim 1 wherein said opposed second end of said strap is substantially perpendicular to said locking head first end at its point of integral attachment thereto.

10. The apparatus of claim 1 wherein said at least one cam member located on said strap reception channel second opposed, spaced wall surface comprises a pair of rib members having the shape of ramps.

11. The apparatus of claim 10 wherein said pair of rib members is made of crushable material.

12. The apparatus of claim 1 wherein said third series of locking ratchets on said movable locking member extend transversely beyond the transverse extent of said second series of locking ratchets on said movable member.

13. The apparatus of claim 12 wherein said movable locking member has a first end portion extending transversely with respect to said third and fourth wall surfaces of said strap reception channel and said third series of locking ratchets is located on said first end portion of said movable locking member.

14. The apparatus of claim 13 wherein said movable locking member first end portion occupies substantially the entire transverse extent of said axial clearance space at the second opposed end of said locking head and defines a concave surface protruding beyond said second opposed end of said locking head against which said movable member is adapted to be pushed to cause said movable locking member to move axially from a non-locked condition to a locked condition.

15. The apparatus of claim 13 wherein said movable locking member has a second end portion extending transversely with respect to said third and fourth wall surfaces of said strap reception channel and said second series of locking ratchets is located on said second end portion of said movable locking member, and wherein said second end portion of said movable locking member is adapted to be engaged by said cam member and be wedged against said locking ratchet support member when said movable locking member is in the locked condition.

16. The apparatus of claim 1 wherein said restraining apparatus comprises a single-loop handcuff restraint.

* * * * *